US011476621B2

(12) United States Patent
Moon et al.

(10) Patent No.: US 11,476,621 B2
(45) Date of Patent: Oct. 18, 2022

(54) CONNECTOR ASSEMBLIES FOR COMPUTING DEVICES

(71) Applicant: Hewlett-Packard Development Company, L.P., Spring, TX (US)

(72) Inventors: Philip Moon, Spring, TX (US); Marcus Townsend, Spring, TX (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/043,302

(22) PCT Filed: Jul. 11, 2018

(86) PCT No.: PCT/US2018/041709
§ 371 (c)(1),
(2) Date: Sep. 29, 2020

(87) PCT Pub. No.: WO2020/013823
PCT Pub. Date: Jan. 16, 2020

(65) Prior Publication Data
US 2021/0119383 A1 Apr. 22, 2021

(51) Int. Cl.
*H01R 33/00* (2006.01)
*H01R 13/639* (2006.01)
*H01R 25/00* (2006.01)

(52) U.S. Cl.
CPC ..... *H01R 13/6392* (2013.01); *H01R 25/003* (2013.01); *H01R 2201/06* (2013.01)

(58) Field of Classification Search
CPC ..... H01R 25/00; H01R 31/06; H01R 33/88; H01R 33/94; H01R 13/94; H01R 13/639; H01R 13/6397
USPC ..... 439/638
See application file for complete search history.

(56) References Cited

U.S. PATENT DOCUMENTS 6,449,992 B1 * 9/2002 Yu ..... E05B 73/0082 70/426
6,619,081 B1 * 9/2003 Yu ..... E05B 73/0005 70/58
6,968,716 B1 * 11/2005 Ling ..... E05B 73/0005 70/58
7,076,977 B2 * 7/2006 Lee ..... E05B 73/0082 411/910

(Continued)

FOREIGN PATENT DOCUMENTS

CN 102227661 A 10/2011
CN 102763240 A 10/2012

(Continued)

*Primary Examiner* — Phuong Chi Thi Nguyen
(74) *Attorney, Agent, or Firm* — HP, Inc. Legal Dept

(57) ABSTRACT

Connection assemblies are disclosed herein for use with a computing device. In some examples, the connection assembly includes a collar that is rotatably disposed about a first connector and is transitionable between a first position and a second position. When the collar is in the first position, shoulders of a second connector coupled to the first connector interfere with corresponding shoulders within the collar to prevent withdrawal of the second connector from the first connector. When the collar is in the second position, the shoulders of the second connector are misaligned with the corresponding shoulders within the collar so that the second connector is freely removable from the first connector.

15 Claims, 7 Drawing Sheets

(56) References Cited

U.S. PATENT DOCUMENTS

| | | | | |
|---|---|---|---|---|
| 7,234,326 | B1 * | 6/2007 | Lu | E05B 73/0082 70/57 |
| 7,270,560 | B1 | 9/2007 | Bodmann et al. | |
| 7,331,203 | B2 * | 2/2008 | Lee | A47F 7/024 70/491 |
| 7,353,672 | B2 * | 4/2008 | Lu | E05B 73/0005 70/57 |
| 7,409,842 | B2 * | 8/2008 | Kuo | E05B 13/105 70/58 |
| 7,429,187 | B1 | 9/2008 | Gurak | |
| 7,465,181 | B1 | 12/2008 | Bridges et al. | |
| 7,635,272 | B2 | 12/2009 | Poppe | |
| 7,722,369 | B2 | 5/2010 | Bushby | |
| 8,485,005 | B2 * | 7/2013 | Tsai | E05B 73/0005 70/424 |
| 8,907,216 | B2 | 12/2014 | Backus et al. | |
| 9,646,179 | B1 | 5/2017 | Munns et al. | |
| 9,858,212 | B2 * | 1/2018 | Clark | G06F 21/83 |
| 10,522,946 | B1 * | 12/2019 | Upadhyaya | H01R 13/6397 |
| 2003/0161096 | A1 | 8/2003 | Zhihong | |
| 2010/0084917 | A1 | 4/2010 | Tsao | |
| 2013/0223920 | A1 | 8/2013 | Donohue | |
| 2013/0316557 | A1 | 11/2013 | Kao et al. | |
| 2014/0308838 | A1 | 10/2014 | Kuo | |
| 2017/0271825 | A1 | 9/2017 | Roe et al. | |

FOREIGN PATENT DOCUMENTS

| | | | |
|---|---|---|---|
| CN | 203561944 | U | 4/2014 |
| CN | 104009330 | A | 8/2014 |
| TW | M352836 | U | 3/2009 |

* cited by examiner

CONNECTOR ASSEMBLIES FOR COMPUTING DEVICES

BACKGROUND

Computing devices (e.g., laptop computers, desk top computers, tablet computers, smart phones, etc.) often include connectors (e.g., electrical connectors) for engaging with corresponding connectors disposed on or coupled to other devices (e.g., printers, projectors, portable memory devices, power sources and adapters, etc.). As a result, it is desirable for a user to selectively ensure that the connector on the computing device maintains its engagement with the corresponding connector on the separate device so that communications between the devices are not prematurely interrupted.

BRIEF DESCRIPTION OF THE DRAWINGS

Various examples will be described below referring to the following figures.

DETAILED DESCRIPTION

Figure 1:
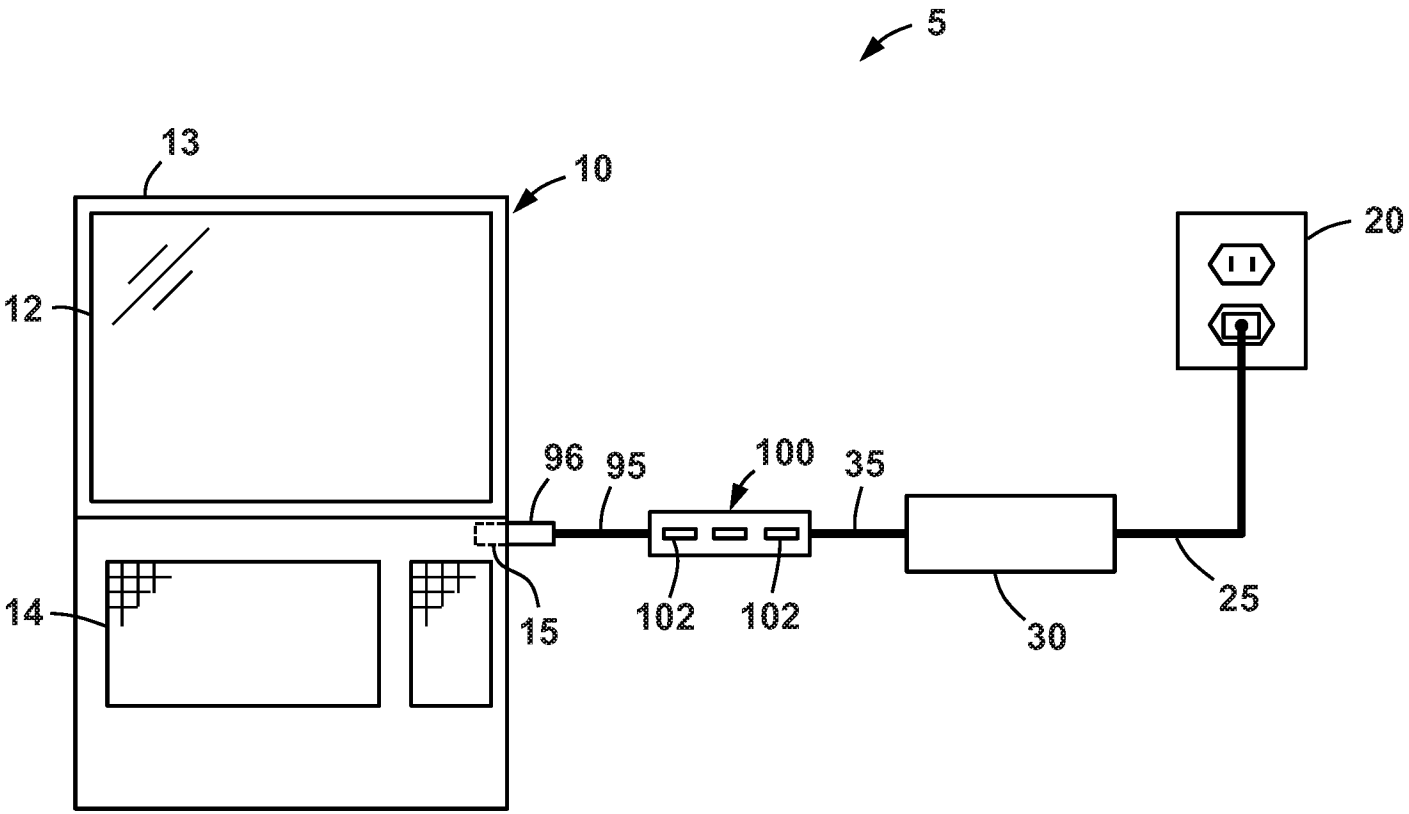
FIG. 1 is a schematic view of a computing system in accordance with examples disclosed herein.

In the figures, certain features and components disclosed herein may be shown exaggerated in scale or in somewhat schematic form, and some details of certain elements may not be shown in the interest of clarity and conciseness. In some of the figures, in order to improve clarity and conciseness, a component or an aspect of a component may be omitted.

In the following discussion and in the claims, the terms "including" and "comprising" are used in an open-ended fashion, and thus should be interpreted to mean "including, but not limited to . . . ." Also, the term "couple" or "couples" is intended to be broad enough to encompass both indirect and direct connections. Thus, if a first device couples to a second device, that connection may be through a direct connection or through an indirect connection via other devices, components, and connections. In addition, as used herein, the terms "axial" and "axially" generally refer to positions along or parallel to a central or longitudinal axis (e.g., central axis of a body or a port), while the terms "radial" and "radially" generally refer to positions located or spaced to the side of the central or longitudinal axis.

As used herein, including in the claims, the word "or" is used in an inclusive manner. For example, "A or B" means any of the following: "A" alone, "B" alone, or both "A" and "B." In addition, when used herein including in the claims, the word "generally" or "substantially" means within a range of plus or minus 20% of the stated value. As used herein, the terms "downstream" and "upstream" are used to refer to the arrangement of components and features within a printer with respect to the "flow" of print media through the printer during a printing operation. Thus, if a first component of a printer receives print media after it is output from a second component of the printer during a printing operation, then the first component may be said to be "downstream" of the second component and the second component may be said to be "upstream" of the first component.

As previously described, it is desirable for a user to selectively ensure that an electrical connector on the computing device maintains its engagement with a corresponding connector on (or coupled to) a separate device (e.g., printer, projector, portable memory device, power source, power adapter, etc.) so that communications between the computing device and separate device are not prematurely interrupted. In many modern computing devices, the number of available connectors for interfacing with separate devices is often minimized due to a host of design considerations (e.g., size, shape, weight, feel, etc.). As a result, it may be desirable to utilize a separate adapter or connector assembly that is connectable with the computing device and provides additional connectors thereon. For such connector assemblies, it is also desirable to selectively maintain the engagement between electrical connectors carried thereon and corresponding connectors coupled to the separate devices so as to prevent premature disconnection. Accordingly, examples disclosed herein include connector assemblies and computing systems that include such connector assemblies, wherein the connector assembly includes a collar that is transitionable between locked and unlocked positions so that a user may selectively allow or prevent the disconnection of engaged electrical connectors.

Referring now to FIG. 1, a computing system 5 is shown. Computing system 5 generally includes a computing device 10, a connector assembly 100, and a power adapter 30. Computing device 10 may comprise any suitable device for carrying out machine readable instructions such as, for example, a desk top computer, a lap top computer, a smart phone, a tablet computer, etc. In this example, computing device 10 is a lap top computer comprising a housing 13 that supports a display 12 and a user input device 14 (e.g., a keyboard).

In addition, computing device 10 includes an electrical connector 15 for connecting with a corresponding electrical connector 96 to receive electrical power. In particular, power adapter 30 receives electrical power from a local source 20 (e.g., such as a wall plug as shown) via a cable 25. Power adapter 30 converts the electrical power received from source 20 into a form (e.g., DC current) that is usable by the computing device 10. The converted electrical power is then provided from power adapter 30 through connector assembly 100 and finally to computing device 10 via cables 35, 95 and connectors 96, 15.

Connector assembly 100 is coupled between power adapter 30 and computing device 10 via cables 35, 95. In this example, connector assembly 100 includes a plurality of electrical connectors 102 that provide additional inputs for interfacing with computing device 10. For example, connectors 102 may comprise a high-definition multimedia interface (HDMI) connectors, universal serial bus (USB) connectors, Ethernet connector, or combinations thereof. In at least some implementations, connectors 102 (or some of the connectors 102) may receive electrical power via the connection to source 20 via power adapter 30 to facilitate their use with computing device 10. In this example, connector assembly 100 may be referred to as a dongle. Further details of connector assembly 100 will now be described with reference to FIGS. 2-4.

Figure 2:
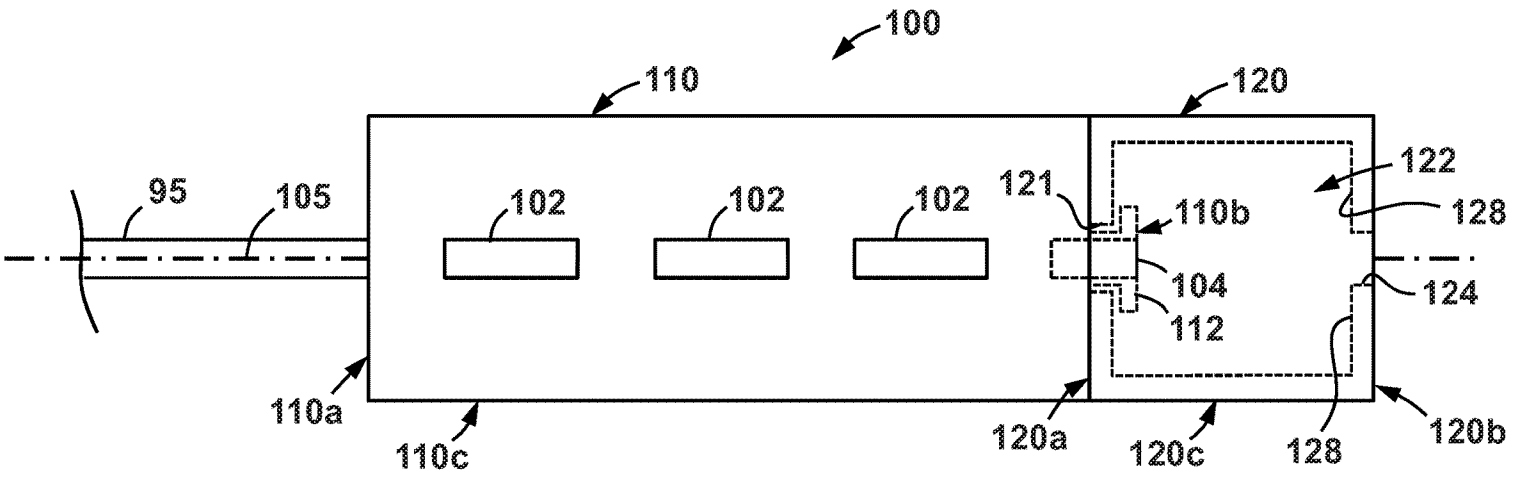
FIG. 2 is a side schematic view of a connector assembly for use within the computing system of FIG. 1.
Figure 3:
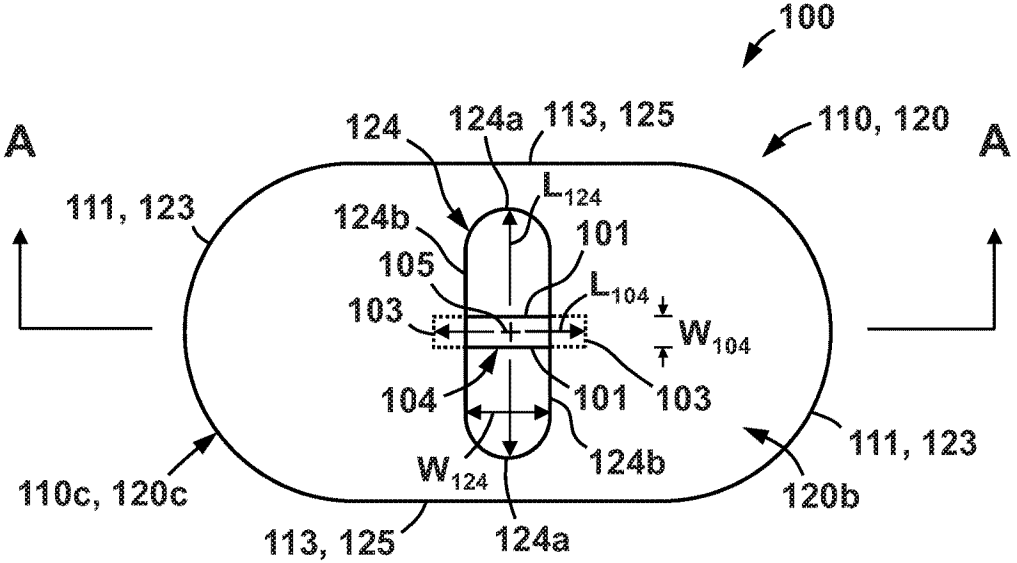
FIG. 3 is a front schematic view of the connector assembly of FIG. 2.
Figure 4:
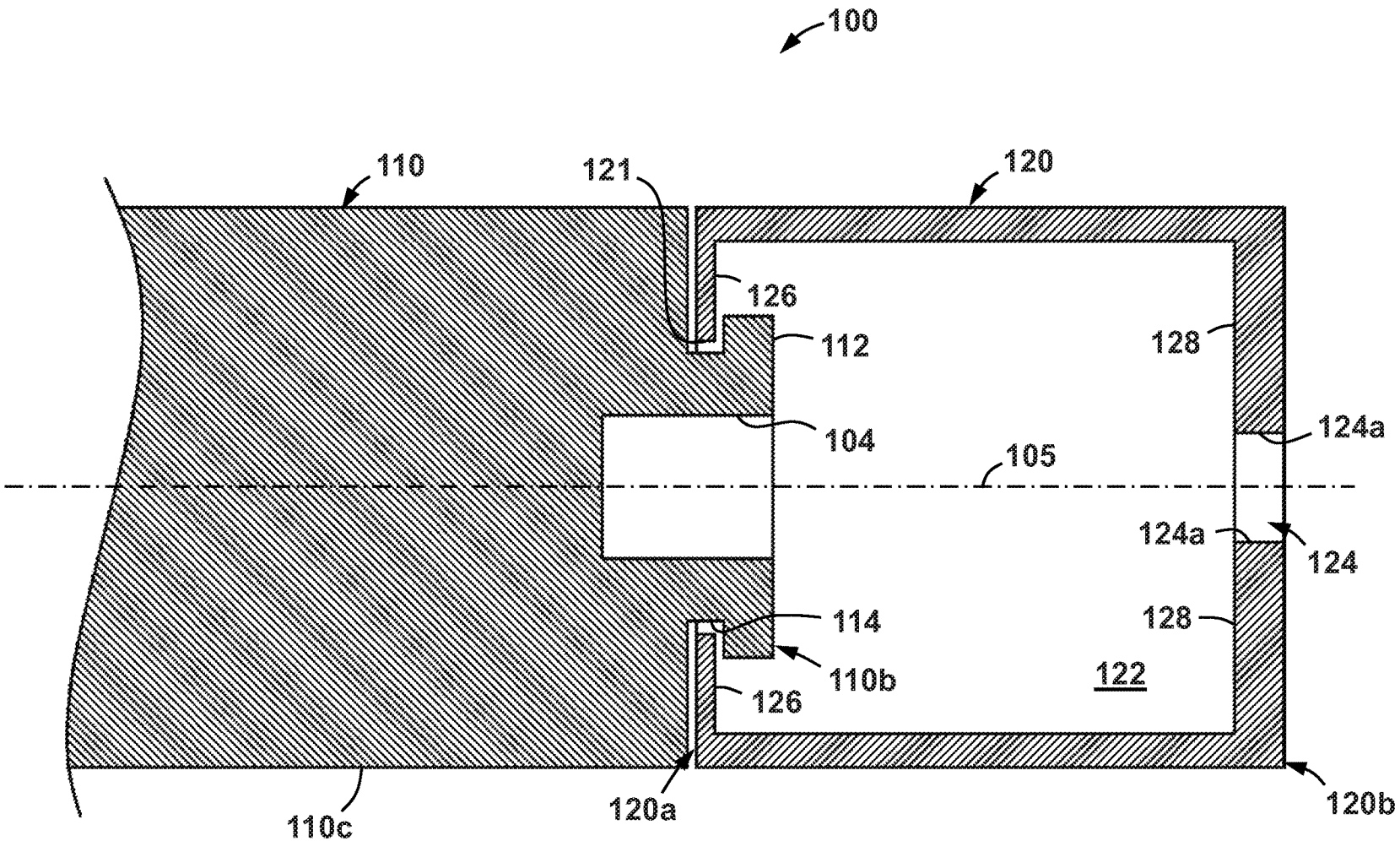
FIG. 4 is a cross-sectional view taken along section A-A in FIG. 3.

Referring now to FIGS. 2-4, connector assembly 100 includes a central or longitudinal axis 105, a body 110, and a collar 120 (which may be referred to as a locking mechanism) rotatably coupled to body 110. Body 110 includes a first end 110*a*, a second end 110*b* opposite first end 110*a*, and a radially outer surface 110*c* extending axially between ends 110*a*, 110*b*. Body 110 may have any suitable shape or cross-section (e.g., rectangular, circular, oval, triangular, etc.). As best shown in FIG. 3, in this example, body 110 has an oblong radial cross-section such that radially outer surface 110*c* includes a pair of radially opposed circular sides 111 joined by a pair of radially opposed linear sides 113 extending tangentially between circular sides 111.

Body 110 carries the electrical connectors 102 and includes internal electronics (e.g., cabling, wiring, etc.) (not shown) to facilitate coupling of the connectors 102 to computing device 10 (see FIG. 1) and/or power adapter 30 via cables 95, 35. In addition, cable 95 extends from first end 110*a* of body 110 and includes an electrical conductor (or plurality of electrical conductors) coupled to the internal electronics (not shown) within body 110. As shown in FIG. 1, cable 95 includes a connector 96 that is to engage with a corresponding connector on housing 13 of computing device 10.

Referring still to FIGS. 2-4, body 110 also includes a mechanical connector 112 at second end 110*b* that defines an annular or circumferential groove or recess 114 extending radially inward toward axis 105 (see FIG. 4). In addition, an electrical connector 104 extends axially into body 110 from second end 110*b* that is to mate with a corresponding electrical connector (e.g., connector 40 described below and shown in FIGS. 7 and 8) on cable 35 from power adapter 30 (see FIG. 1). In this example, connector 104 is a female connector and the corresponding connector on cable 35 is a male connector. Accordingly, in this implementation, connector 104 may be referred to as a body connector and may comprise any suitable connector type that may receive and transfer electrical power therethrough, such as, for example, a USB connector (e.g., USB type C connector), a power coupling, etc. As best shown in FIG. 3, in this example, connector 104 has a generally rectangular radial cross-section about axis 105. Thus, connector 104 has a pair of radially opposed first sides 101, and a pair of radially opposed second sides 103 that extend between first sides 101. Connector 104 is radially elongated across axis 105 along the first sides 101, and thus includes a radial length $L_{104}$ extending along first sides 101 that is longer than its radial width $W_{104}$, that extends perpendicularly to first sides 101. In addition, in this example, first sides 101 are each longer than second sides 103. In other examples, connector 104 may have a generally oblong radial cross-section as described above for collar 120 and body 110. In these examples, the connector 104 would again have a radial length (e.g., $L_{104}$) that is longer than its radial width (e.g., $W_{104}$).

Collar 120 includes a first end 120*a*, a second end 120*b* opposite first end 120*a*, and a through passage 122 extending between ends 120*a*, 120*b*. In addition, collar 120 includes a radially outer surface 120*c* extending axially between ends 120*a*, 120*b*. As with body 110, collar 120 may have any suitable shape or cross-section (e.g., rectangular, circular, oval, triangular, etc.). As best shown in FIG. 3, in this example, collar 120 has a radial cross-section that substantially matches that of body 110. Accordingly, as best shown in FIG. 3, in this example, collar 120 has an oblong radial cross-section such that radially outer surface 120*c* includes a pair of radially opposed circular sides 123 joined by a pair of radially opposed linear sides 125 extending tangentially between circular sides 123 (note: the radially outer surfaces 110*c*, 120*c* of body 110 and collar 120, respectively, are substantially aligned (and flush) in FIG. 3 such that the corresponding, aligned surfaces 111, 123 and 113, 125 are each identified with the same leader line).

In addition, collar 120 includes a first opening 121 into through passage 122 disposed at the first end 120*a*, and a second opening 124 into through passage 122 disposed at second end 120*b*. As best shown in FIG. 4, openings 121, 124 are coaxially aligned along axis 105. In addition, first opening 121 defines an annular or circumferential shoulder 126 that extends radially with respect to axis 105 (see FIG. 4). When connector assembly 100 is fully constructed, connector 112 on body 110 is disposed within through passage 122 via the first opening 121 of collar 120 such that annular shoulder 126 is received (e.g., partially received) within annular recess 114. As a result, axial movement of collar 120 relative to body 110 is restricted, but collar 120 is free to rotate about axis 105 relative to body 110 with shoulder 126 slidingly engaging with the walls of recess 114. Therefore, collar 120 is rotatably coupled to body 110 about axis 105 as previously described above.

Referring still to FIGS. 2-4, opening 124 may have any suitable shape (e.g., rectangular, oval, triangular, etc.) to facilitate selective passage of a corresponding connector (e.g., connector 40) therethrough. In this example, opening 124 has an oblong shape in a radial plane that includes a pair of circular ends 124*a* joined by a pair of opposing linear sides 124*b*, where the linear sides 124*b* extend tangentially to the circular ends 124*a*. Therefore, opening 124 is radially elongated across axis 105 along linear sides 124*b* such that opening has a radial length $L_{124}$ that is greater than its radial width $W_{124}$ with length $L_{124}$ extending along linear sides 124*b*, and width $W_{124}$ extending perpendicularly to length $L_{124}$. In addition, opening 124 defines a pair of radially extending shoulders 128 within collar 120 at second end 120*b* that are each substantially radially aligned with one of the linear sides 124*b*. As a result, shoulders 128 radially oppose one another about axis 105 such that each shoulder 128 is disposed approximately 180° from the other shoulder 128 about axis 105 (see FIG. 4).

Figure 5:
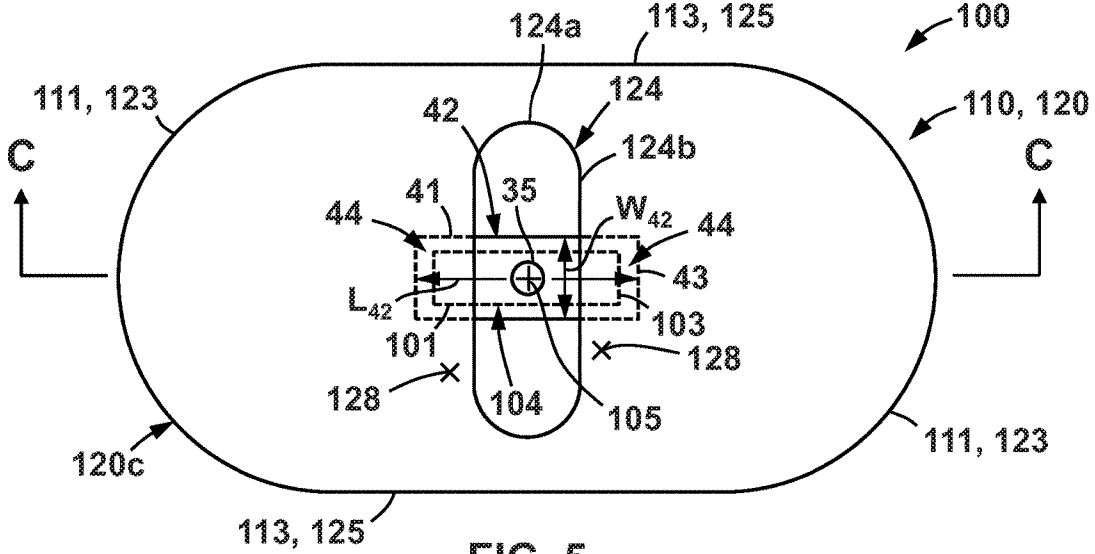
FIG. 5 is a schematic front view of the connector assembly of FIG. 2, showing a locking collar in a locked position.
Figure 6:
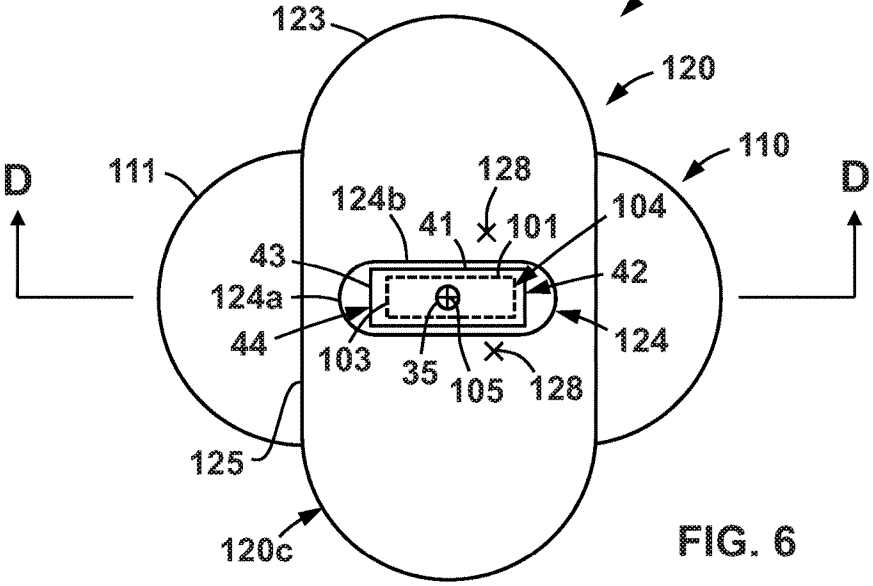
FIG. 6 is a schematic front view of the connector assembly of FIG. 2 showing a locking collar in an unlocked position.
Figure 7:
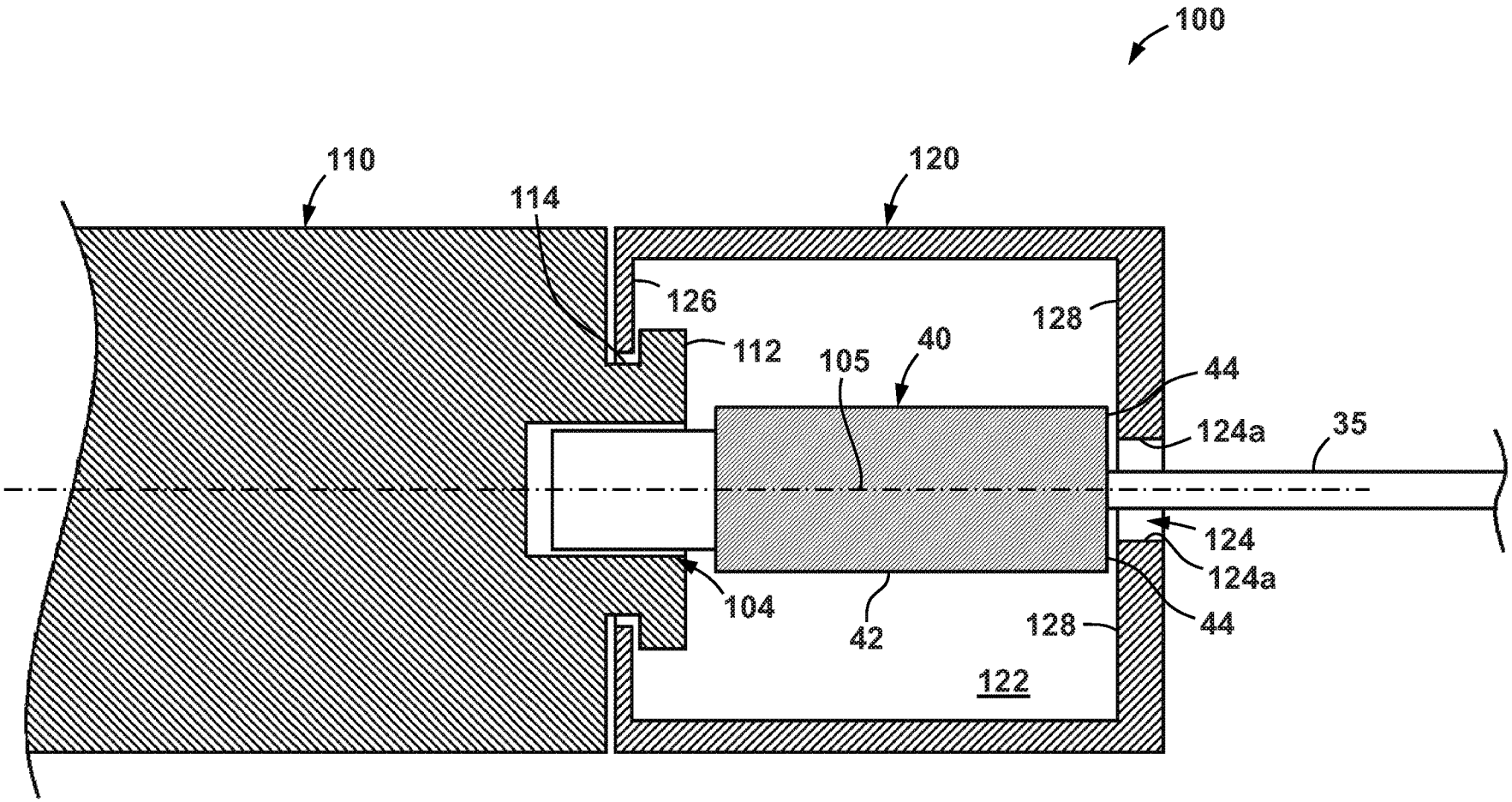
FIG. 7 is a cross-sectional view taken along section C-C in FIG. 5.
Figure 8:
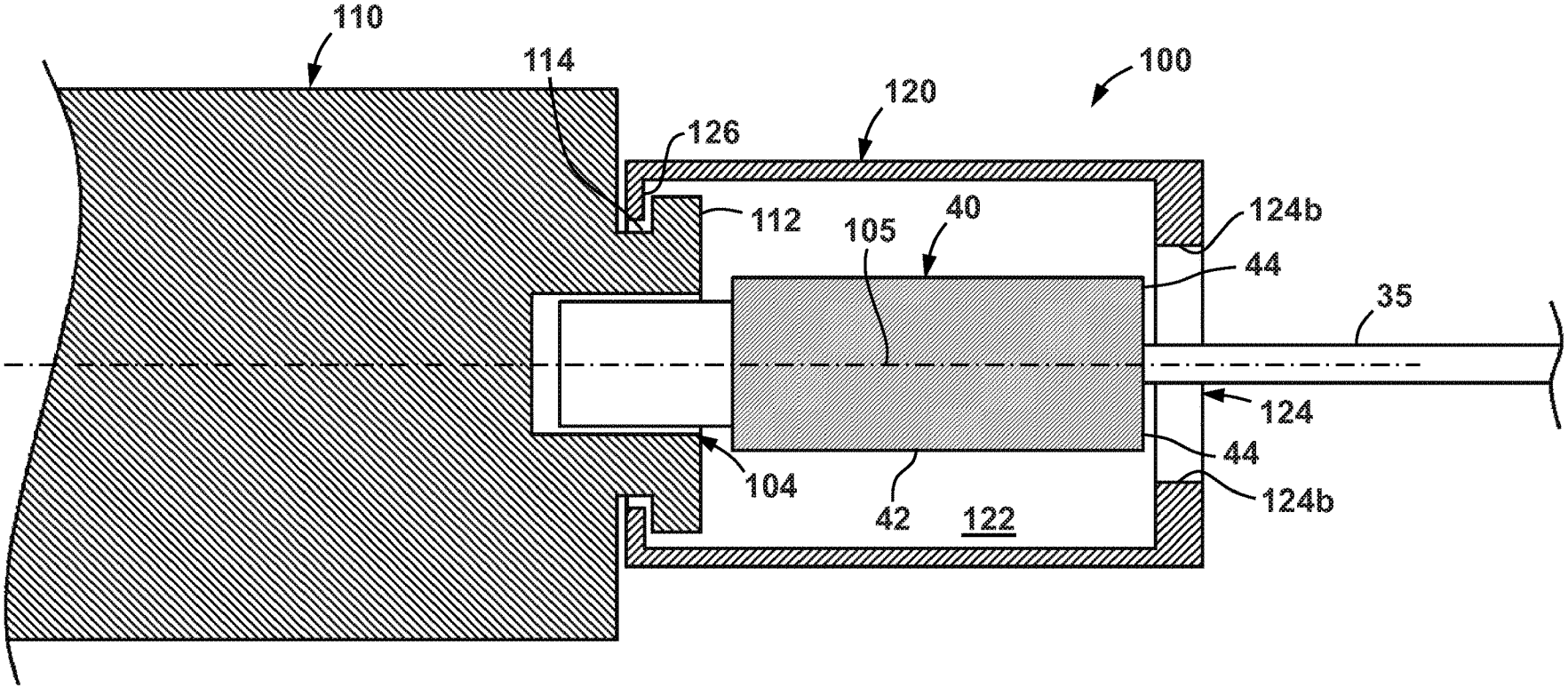
FIG. 8 is a cross-sectional view taken along section D-D in FIG. 6.

Referring now to FIGS. 5-8, collar 120 is rotatable about axis 105 relative to body 110 between a first or locked position, and a second or unlocked position. For example, FIGS. 5 and 7 show collar 120 in the locked position, while FIGS. 6 and 8 show collar 120 in the unlocked position. As will be described in more detail below, when collar 120 is in the locked position (e.g., the position of FIGS. 5 and 7), a male connector (e.g., connector 40 described below) for connecting with connector 104 may not be either inserted into or withdrawn from through passage 122 via opening 124. Conversely, when the collar 120 is in the unlocked position (e.g., the position of FIGS. 6 and 8), a male connector (e.g., connector 40 described below and shown in FIGS. 7 and 8) for connecting with connector 104 may be freely inserted into or withdrawn from through passage 122 via opening 124. In this example, the collar 120 is rotated approximately 90° about axis 105 between the locked position (e.g., FIGS. 5 and 7) and the unlocked position (e.g., FIGS. 6 and 8).

In describing the positions of collar 120, reference will be made to the interaction between collar 120 and connector 104 of connector assembly 100 and an electrical connector 40 disposed on a terminal end of cable 35 that extends from power adapter 30 as previously described (see FIG. 1). Thus, connector 40 may be referred to herein as a cable connector. Briefly, as shown in FIGS. 7 and 8, connector 40 is a male connector that includes a connector head 42 (or more simply "head 42") that defines a pair of radially opposing shoulders 44. Head 42 may provide a gripping surface for a user and may also provide a cavity (not shown) to receive the internal electronics (not shown) associated with connector 40. Connector 40 is shaped and designed to engage with connector 104. In addition, connector 40 may be properly engaged with connector 104 on body 110 when connectors 40, 104 are in a particular relative angular orientation (or a defined set of angular orientations) about axis 105. The proper orientation of connectors 40, 104 is a function of the type, shape, and function of the connectors 40, 104, and thus, such orientations may differ in various examples. In this example, the cross-section of head 42 of cable connector 40 is generally rectangular (such that radially opposed shoulders 44 are defined on head 42 as previously described). In particular, head 42 includes a pair of radially opposing first sides 41 and a pair of radially opposing second sides 43 extending between the first sides 41. Therefore, head 42 is radially elongated across axis 105 along the first sides 41, and thus includes a radial length $L_{42}$ extending along first sides 41 that is longer than its radial width $W_{42}$, that extends perpendicularly to first sides 41. In addition, in this example, each first side 41 is longer than each second side 43. When connector 40 is to engage (or is engaged) with connector 104, first sides 41 of head 42 are substantially circumferentially or angularly aligned with first sides 101 of connector 104.

Referring now to FIGS. 5 and 7, when collar 120 is in the locked position, the linear sides 124*b* of opening 124 are circumferentially or angularly misaligned (e.g., by approximately 90°) with the first sides 101 of connector 104. In other words, the radial length $L_{124}$ of opening 124 (see FIG. 3) is circumferentially or angularly misaligned with the radial length $L_{104}$ of connector 104 (e.g., by approximately 90°). In addition, if connector 40 is disposed within through passage 122 and engaged with connector 104 when collar 120 is in the locked position, the first sides 41 of head 42 are also circumferentially or angularly misaligned (e.g., by approximately 90°) with the linear sides 124*b* of opening 124. In other words, the radial length $L_{124}$ of opening 124 is circumferential or angularly misaligned with radial length $L_{42}$ of head 42 (e.g., by approximately 90°). Accordingly, when collar 120 is in the locked position and the connector 40 is disposed within through passage and engaged with connector 104, radially opposed shoulders 128 of opening 124 are substantially circumferentially aligned with and therefore axially overlap with shoulders 44 of head 42.

As a result, when connector 40 is disposed within through passage 122 and engaged with connector 104, and collar 120 is in the locked position, shoulders 128, 44 axially interfere with one another to prevent withdrawal of connector 40 from through passage 122. Specifically, in this example, when connector 40 is inserted within through passage 122 and engaged with connector 104, and collar 120 is in the locked position, the shoulders 128, 44 axially overlap as previously described but are not engaged. Accordingly, when collar 120 is in the locked position, some axial movement of connector 40 relative to connector 104 is tolerated (that is, until shoulders 128, 44 engage one another), but collar 120 is prevented from being withdrawn entirely from through passage 122. In other examples, when connector 40 is inserted within through passage 122 and engaged with connector 104, and collar 120 is in the locked position, the shoulders 128, 44 engage to prevent any axial movement of connector 40 relative to connector 104. In these examples, preventing any relative, axial movement of connectors 104, 40 may prevent the undesired loss of electrical connection therebetween.

In addition, when collar 120 is in the locked position of FIGS. 5 and 7, connector 40 may not be inserted within through passage 122 in an orientation for engagement with connector 104 due to the interference between head 42 and opening 124. In particular, the angular misalignment (e.g., by approximately 90°) between the first sides 41 of head 42 and linear sides 124*b* of opening 124 prevents the insertion of connector 40 into opening 124 through passage 122 in an orientation for engagement with connector 104 (wherein sides 41 are aligned with sides 101 as previously described).

Referring now to FIGS. 6 and 8, when collar 120 is in the unlocked position, the linear sides 124*b* of opening 124 are substantially circumferentially or angularly aligned with the first sides 101 of connector 104. In other words, the radial length $L_{124}$ of opening 124 (see FIG. 3) is substantially circumferentially or angularly aligned with the radial length $L_{104}$ of connector 104. In addition, if connector 40 is disposed within through passage 122 and engaged with connector 104 when collar 120 is in the unlocked position, the first sides 41 of head 42 are also substantially circumferentially or angularly aligned with the linear sides 124*b* of opening 124. In other words, the radial length $L_{124}$ of opening 124 is substantially circumferential or angularly aligned with radial length $L_{42}$ of head 42. Accordingly, when collar 120 is in the unlocked position and the connector 40 is disposed within through passage and engaged with connector 104, radially opposed shoulders 128 of opening 124 are substantially circumferentially misaligned (e.g., by approximately 90°) with shoulders 44 of head 42.

Moreover, when connector 40 is disposed within through passage 122 and engaged with connector 104, and collar 120 is in the unlocked position, the axial withdrawal of connector 40 from through passage 122 through opening 124 may be allowed or facilitated (i.e., due to the misalignment of shoulders 128, 44). Similarly, when collar 120 is in the unlocked position of FIGS. 6 and 8, connector 40 may be freely inserted through opening 124 into through passage 122 in an orientation for engagement with connector 104, since the sides 101, 41, 124*b* of connector 104, head 42, and opening 124, respectively, are all substantially circumferentially or angularly aligned with one another about axis 105.

Referring briefly again to FIGS. 5 and 6, in this example, when collar 120 is in the locked position (FIG. 5), radially outer surfaces 110*c*, 120*c* of body 110 and collar 120, respectively, are relatively oriented such that circular sides 111 are substantially circumferentially or angularly aligned with circular sides 123 and linear sides 113 are substantially circumferentially or angularly aligned with linear sides 125. In addition, when collar 120 is in the unlocked position (FIG. 6), radially outer surfaces 110*c*, 120*c* of body 110 and collar 120, respectively, are relatively oriented such that circular sides 111 are circumferentially or angularly misaligned (e.g., by approximately 90°) with circular sides 123 and linear sides 113 are circumferentially or angularly misaligned (e.g., by approximately 90°) with linear sides 125.

In addition, while not specifically shown, in at least some implementations, the collar 120 may be maintained in either the locked or unlocked positions (e.g., see FIGS. 5-8) to ensure that actuation of collar 120 between these positions occurs when desired by a user. For example, in some implementations, the friction caused by the engagement of shoulder 126 and the surfaces forming recess 114 is high enough to prevent rotational movement of the collar 120 about body 110 unless additional force or pressure is provided by a user. In other implementations, mechanical snaps or latches (not shown) may be used to maintain the collar 120 in the locked position and/or the unlocked position.

Referring still to FIGS. 1 and 5-8, during operations with system 5, a user may couple connector assembly 100 between power adapter 30 and computing device 10 to provide additional electrical connector inputs for use with computing device 10 as previously described. Initially, collar 120 of connector assembly 100 may be placed in the unlocked position (e.g., FIGS. 6 and 8) so that connector 40 or cable 35 may be inserted into through passage 122 and engaged with connector 104. Thereafter, to prevent the undesired loss of electrical connection between computing device 10 and power adapter 30, collar 120 of connector assembly 100 may be transitioned to the locked position (e.g., FIGS. 5 and 7) to prevent the undesired disconnection of connectors 40, 104 in the manner described above. When it becomes desirable to disconnect power adapter 30 from connector assembly 100 and computing device 10 (e.g., such as when operations with computing device 10 have ceased), the user may transition or rotate the collar 120 from the locked position (e.g., FIGS. 5 and 7) back to the unlocked position (e.g., FIGS. 6 and 8) to allow the disconnection of connectors 40, 104 and withdrawal of connector 104 from through passage 122 via opening 124. Accordingly, through use of a connector assembly as described herein (e.g., connector assembly 100), a user may selectively prevent the undesired or premature disconnection between a pair of engaged connectors within a computing system (e.g., computing system 5) such that the reliability and function of the computing system is enhanced.

Figure 9:
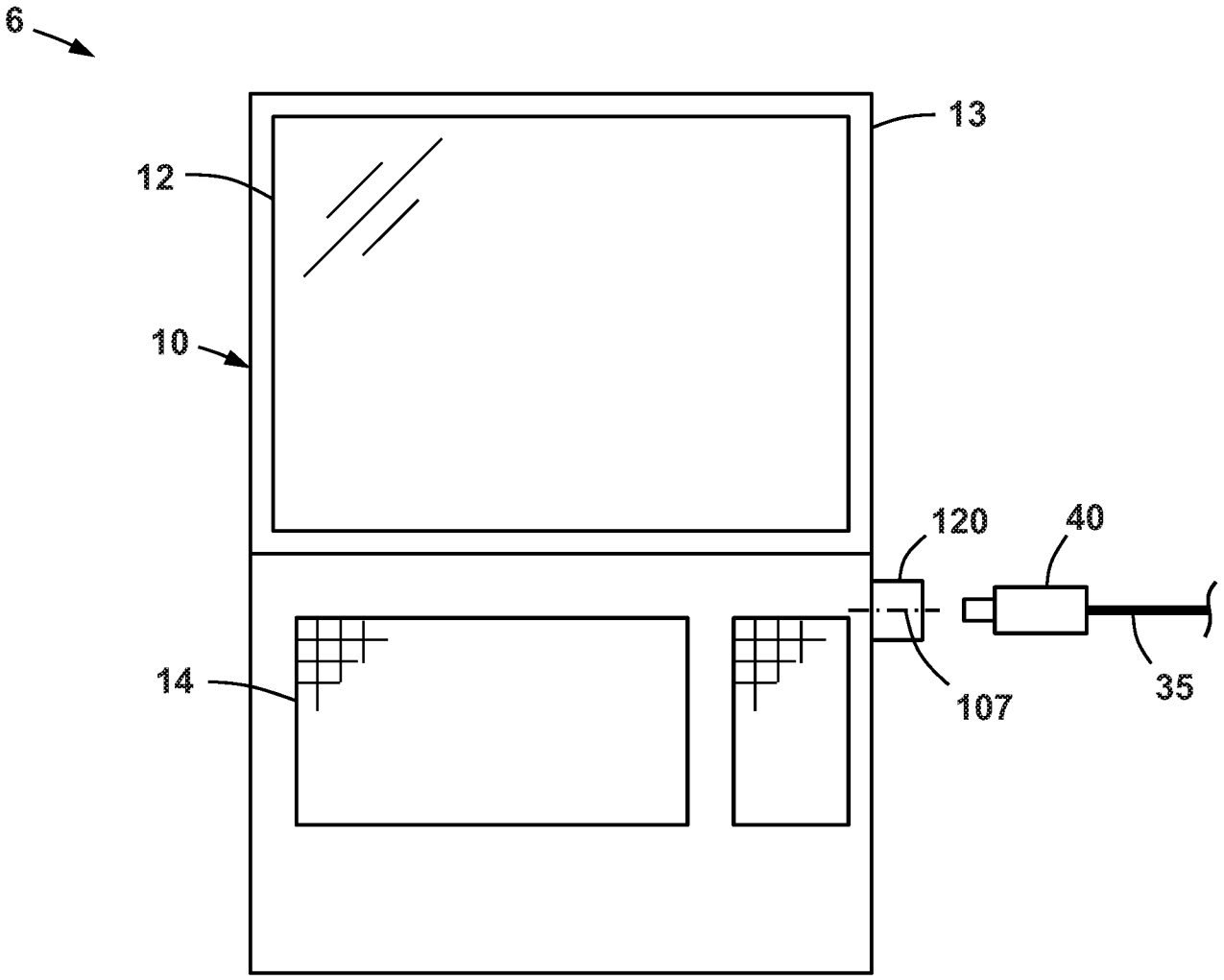
FIG. 9 is a schematic view of another computing system in accordance with examples disclosed herein.

While examples disclosed herein have included a connector assembly that is separate from a computing device (e.g., connector assembly 100), in other examples, similar connector assemblies may be included on other portions or components of a computing system (e.g., computing system 5). For example, referring briefly to FIG. 9, a computing system 6 is shown wherein collar 120 (which is the same as previously described above) is rotatably disposed directly on housing 13 of computing device 10 about an electrical connector (not shown). In this example, collar 120 is rotatable relative to housing 13 about an axis 107 between locked and unlocked positions as described above for collar 120 on connector assembly 100. Thus, in this example, the collar 120 may be referred to as a "connector assembly," that is directly mounted to housing 13. During operations, collar 120 receives a corresponding cable connector (e.g., cable connector 40) in the same manner as described above (e.g., connector assembly 100), and thus, such description will not be repeated in the interest of brevity. In other implementations, a similar locking collar (e.g., collar 120) of a connector assembly may be included on a separate device (e.g., printer, projector, portable memory device, power source, power adapter, etc.) that is connectable to a computing device (e.g., computing device 10). Thus, the depiction of a separate connector assembly 100 in FIGS. 1-8 is merely illustrative of certain examples and is not limiting for all possible uses of similar connector assemblies contemplated herein. In addition, while examples disclosed herein have included a connector assembly that receives a connector from a power adapter (e.g., connector 40 coupled to power adapter 30), similar connector assemblies may receive and interact with connectors associated with other types of devices (e.g., such as those previously described herein).

The above discussion is meant to be illustrative of the principles and various examples of the present disclosure. Numerous variations and modifications will become apparent to those skilled in the art once the above disclosure is fully appreciated. It is intended that the following claims be interpreted to embrace all such variations and modifications.

What is claimed is:

1. A connector assembly, comprising:

a body comprising a body connector for a computing device, the body connector to engage with a corresponding cable connector; and a collar rotatably coupled to the body about an axis, wherein the collar comprises a through passage, wherein the through passage defines a shoulder, wherein the collar is rotatable relative to the body about the axis between a first position and a second position, wherein, when the collar is in the first position and the cable connector is disposed within the through passage, the shoulder is to axially interfere with a corresponding shoulder on the cable connector, and wherein, when the collar is in the second position and the cable connector is disposed within the through passage, the shoulder of the collar is to be circumferentially misaligned with the corresponding shoulder on the cable connector.

2. The connector assembly of claim 1, wherein the through passage defines a pair of shoulders disposed radially opposite one another about the axis, and wherein, when the collar is in the first position and the cable connector is disposed within the through passage and engaged with the body connector, the pair of shoulders in the through passage axially interferes with a pair of corresponding shoulders on the cable connector.

3. The connector assembly of claim 1, wherein the collar comprises an opening into the through passage, wherein, when the collar is in the second position, the opening is to be circumferentially aligned with the body connector such that the cable connector is insertable into the opening and through passage while in a circumferential orientation to mate with the body connector.

4. The connector assembly of claim 1, wherein the collar is to rotate approximately 90° about the axis between the first position and the second position.

5. The connector assembly of claim 1, wherein the cable connector comprises a radial cross-section having a pair of first sides radially opposite one another about the axis, a pair of second sides radially opposite one another about the axis, a radial length extending along the first sides, and a radial width extending along the second sides in a direction that is perpendicular to the radial length, and wherein the radial length is greater than the radial width.

6. The connector assembly of claim 5, wherein the opening comprises a pair of first sides radially opposite one another about the axis, a pair of second sides radially opposite one another about the axis, a radial length extending along the first sides of the opening, and a radial width extending along the second sides of the opening that is perpendicular to the radial length of the opening, and wherein the radial length of the opening is greater than the radial width of the opening.

7. The connector assembly of claim 6, wherein, when the collar is in the first position, the first sides of the body connector are to be circumferentially misaligned with the first sides of the opening.

8. The connector assembly of claim 7, wherein, when the collar is in the second position, the first sides of the body connector are to be substantially circumferentially aligned with the first sides of the opening.

9. A connector assembly, comprising:

a body comprising a body connector for a computing device, the body connector to engage with a corresponding cable connector; and a collar rotatably coupled to the body about an axis, wherein the collar comprises a through passage, and an opening into the through passage;

wherein the body connector includes a radial length and a radial width that extends perpendicularly to the radial length, and wherein the radial length is longer than the radial width, wherein the opening includes a radial length and a radial width that extends perpendicularly to the radial length of the opening, and wherein the radial length of the opening is greater than the radial width of the opening, and wherein the collar is rotatable relative to the body about the axis between a first position, in which the radial length of the opening is to be circumferentially misaligned with the radial length of the body connector, and a second position, in which the radial length of the opening is to be substantially circumferentially aligned with the radial length of the body connector.

10. The connector assembly of claim 9, wherein the collar includes a pair of shoulders radially opposite one another about the axis.

11. The connector assembly of claim 10, wherein the collar is to rotate approximately 90° about the axis between the first position and the second position.

12. The connector assembly of claim 11, wherein, when the cable connector is disposed within the through passage and engaged with the body connector and the collar is in the first position, the pair of shoulders on the collar is to axially interfere with a pair of corresponding shoulders on the cable connector.

13. The connector assembly of claim 12, wherein, when the cable connector is disposed within the through passage and engaged with the body connector and the collar is in the second position, the pair of shoulders on the collar is to be circumferentially misaligned with the pair of corresponding shoulders on the cable connector.

14. A connector assembly, comprising:

a body having a central axis and comprising a female connector for a computing device, the female connector to engage with a corresponding male connector coupled to a cable, wherein the female connector is radially elongated across the central axis; and a collar coupled to the body and rotatable about the central axis, wherein the collar comprises a through passage and an opening into the through passage, wherein the opening is radially elongated across the central axis, wherein the collar is rotatable relative to the body about the central axis between a first position, in which the opening is to be circumferentially misaligned with the female connector, and a second position, in which the opening is to be substantially circumferentially aligned with the female connector.

15. The connector assembly of claim 14, wherein the female connector is a female universal serial bus (USB)-type connector.

* * * * *